US005671794A

United States Patent [19]

Nien

[11] Patent Number: 5,671,794

[45] Date of Patent: Sep. 30, 1997

[54] APPARATUS FOR ADJUSTING THE ORIENTATION OF SLATS OF A VERTICAL BLIND

[76] Inventor: Ming Nien, No. 11, Kungchu Rd., Fangyuan Industrial Dist., Houliao Village, Fangyuan Hsiang, Changhua Hsien, Taiwan

[21] Appl. No.: 698,330

[22] Filed: Aug. 15, 1996

[51] Int. Cl.[6] ..... E06B 9/36

[52] U.S. Cl. ..... 160/176.1 V; 160/900

[58] Field of Search ..... 160/168.1 V, 172 V, 160/176.1 V, 177 V, 115, 900, 178.1 V, 173 V, 341

[56] References Cited

U.S. PATENT DOCUMENTS

| | | | |
|---|---|---|---|
| 3,343,588 | 9/1967 | Cayton | 160/176.1 V |
| 3,500,896 | 3/1970 | Endou | 160/168.1 V |
| 4,122,884 | 10/1978 | Salzmann | 160/168.1 V |
| 4,262,728 | 4/1981 | Debs | 160/172 V |
| 4,291,738 | 9/1981 | Grenga et al. | 160/900 X |
| 4,306,608 | 12/1981 | Frentzel et al. | 160/176.1 V |
| 4,316,493 | 2/1982 | Arena | 160/900 X |
| 4,834,163 | 5/1989 | Dickstein | 160/176.1 V |
| 4,848,435 | 7/1989 | Helver | 160/176.1 V |
| 5,022,453 | 6/1991 | Rozon | 160/178.1 V X |
| 5,056,578 | 10/1991 | Helver | 160/177 V |
| 5,168,913 | 12/1992 | Haines | 160/176.1 V X |
| 5,291,946 | 3/1994 | Ciriaci | 160/177 V |
| 5,413,162 | 5/1995 | Ciriaci | 160/177 V |
| 5,577,542 | 11/1996 | Hung | 160/177 V |

*Primary Examiner*—David M. Purol

*Attorney, Agent, or Firm*—Parkhurst, Wendel & Burr, L.L.P.

[57] ABSTRACT

An apparatus for adjusting the orientation of slats of a vertical blind includes a master slide and a first carrier slide fixedly connected with the master slide and a plurality of other carrier slides. The master slide includes a housing, a driving member, a worm member and a helical gear engaging with the worm member. When the driving member rotates, the helical gear rotates accordingly. A shaft is extended to engage with the helical gear and driven mechanisms provided respectively in the carrier slides. Each driven mechanism is attached with a slat. When the helical gear is rotated, the slats attached with the driven mechanism rotate accordingly so that the orientation of the slats can be adjusted. Each of the carrier slides is slideably engaged with a strip which has an end defining a stop and another end fixedly attached with a carrier slide neighboring the carrier slide slideably engaging with a respective strip.

6 Claims, 5 Drawing Sheets

APPARATUS FOR ADJUSTING THE ORIENTATION OF SLATS OF A VERTICAL BLIND

FIELD OF THE INVENTION

The present invention is related to an apparatus for adjusting the orientation of slats of a vertical blind, wherein the apparatus is slideably mounted on a headrail of the vertical blind and each of the slats is attached on a carrier slide of the apparatus.

BACKGROUND OF THE INVENTION

Generally, a vertical blind consists of a headrail fixedly mounted above a window for the vertical blind to cover, a master slide and a plurality of carrier slides slideably mounted on the headrail and a plurality of slats respectively pivotably mounted on the carrier slides. The master slide and the carrier slides and a force transmission member extending through the master slide and the carrier slides also constitute an apparatus for adjusting the orientation of the slats of the vertical blind.

A conventional vertical blind has a master slider generally including a housing, a driving member rotatably mounted on a center of the housing and having a top end attached with a first gear and a lower end connected with a control rod, a pair of worm members rotatably mounted in two sides of the housing, each worm member having a lower end attached with a second gear engaging the first gear and a worm on an upper portion thereof, and a hollow spur gear engaged between the two worms of the two worm members. The hollow portion of the spur gear is formed to have a toothed configuration and used to engage with a shaft having a configuration corresponding thereto. The shaft extends from the master slide to engage with a driven mechanism in each of the carrier slides. When the control rod is rotated, the shaft rotates accordingly thereby to pivot the driven mechanisms in the carrier slides to change the orientation of the slats attached on the carrier slides via the driven mechanisms.

The structure of the apparatus for adjusting the orientation of slats of the conventional vertical blind has the following disadvantages:

1. Since the hollow spur gear is driven between two worms, the two worms should have different hands of threading of rotation from each other, which means that an operator should be very careful to pick up and check the suitable worm members when assembling the two worm members to the housing.
2. The constituting parts thereof have a relatively large number, which means that the cost thereof is relatively high.
3. Since a large force is required to drive a spur gear by worms, the spur gear is easily worn, which causes the spur gear to have a short life of use.
4. A cord connecting the master slide and the carrier slides is required so that when the cord is pulled downwardly, the master slide and the carrier slides can slide along the headrail to extend or retract the vertical blind. Such a cord may cause danger to a child when playing with the cord as strangulation could occur.

The present invention therefore is aimed to provide an improved apparatus for adjusting the orientation of slats of a vertical blind to mitigate and/or obviate the aforementioned problems.

SUMMARY OF THE INVENTION

An objective of the present invention is to provide an apparatus for adjusting the orientation of slats of a vertical blind wherein the apparatus can be easily assembled.

Another object of the present invention is to provide an apparatus for adjusting the orientation of slats of a vertical blind wherein the apparatus requires a relatively small number of parts to constitute it.

A further objective of the present invention is to provide an apparatus for adjusting the orientation of slats of a vertical blind wherein the apparatus may have a longer life of use.

A still further objective of the present invention is to provide an apparatus for adjusting the orientation of slats of a vertical blind wherein the apparatus does not need a cord to connect therewith for extending or collapsing the blind.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
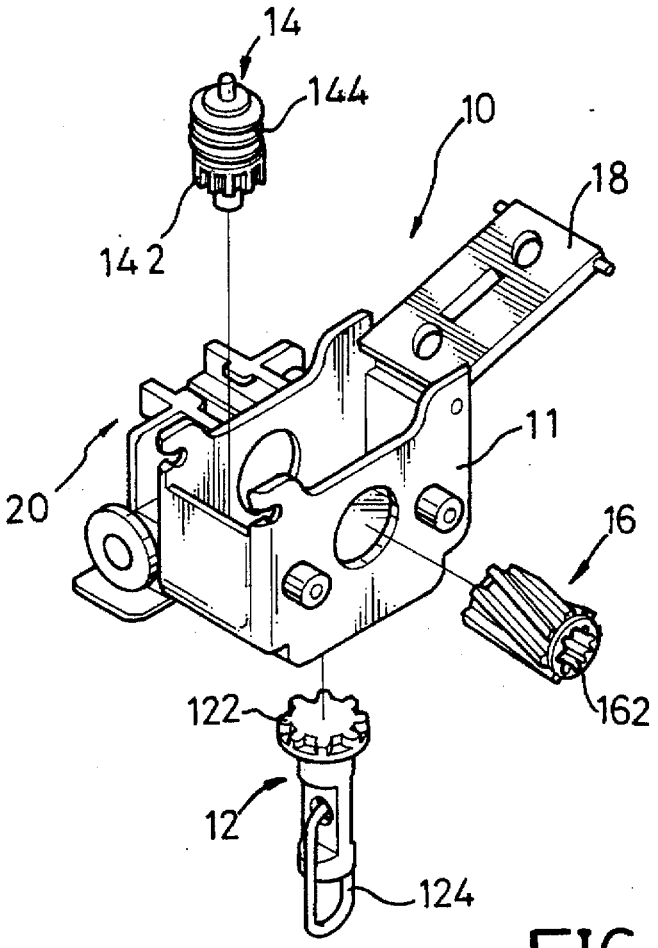
FIG. 1 is a front-left-top perspective, exploded view showing the constituting elements of a master slide and a first carrier slide in accordance with the present invention, wherein the first carrier slide is fixedly attached with the master slide.
Figure 3:
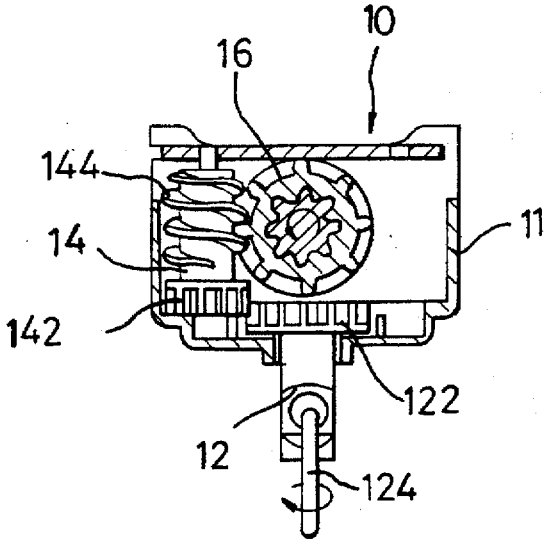
FIG. 3 is a front cross-sectional view showing the master slide of FIG. 1 in an assembled state wherein a force transmission shaft is engaged with a helical gear of the master slide.
Figure 2:
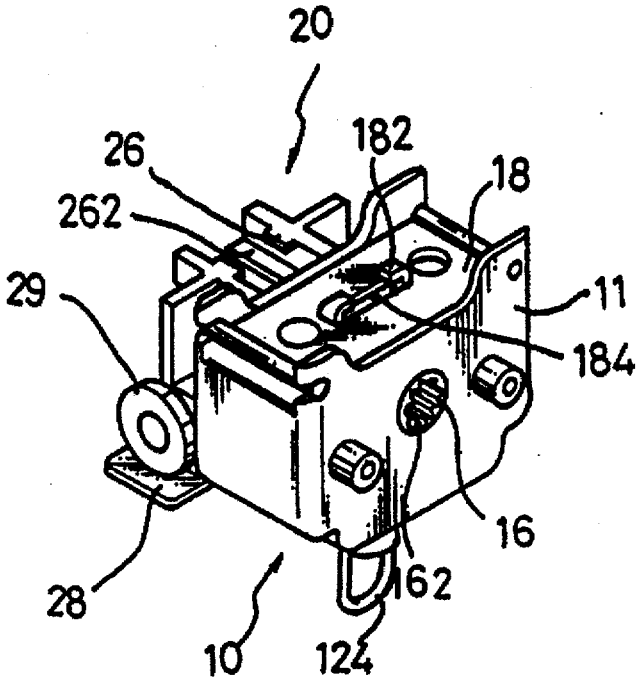
FIG. 2 is a front-left-top perspective view showing the master slide and the first carrier slide of FIG. 1 in an assembled state.

Referring to FIGS. 1 to 3, a master slide 10 of an apparatus for adjusting the orientation of slats of a vertical blind in accordance with the present invention is disclosed. The master slide 10 is fixedly attached with a first carrier slide 20. The master slide 10 consists of a housing 11, a cover 18 pivotably mounted on a top of the housing 11, a driving member 12 vertically and rotatably mounted on the housing 10 which is formed to have a first gear 122 on a top thereof, a worm member 14 vertically and rotatably mounted within the housing 10 which is formed to have a worm 144 and a second gear 142 on a lower portion thereof and engaging with the first gear 122 and a hollow helical gear 16 rotatably mounted in the housing 11, engaging with the worm 144 and extending from a front side to a rear side of the housing 11.

The helical gear 16 has a hollow portion 162 which is formed to have a toothed configuration. A link 124 is attached on the driving member 12 and extends beyond a lower portion thereof. The link 124 is used to be fixedly connected with a control rod (not shown) so that when the control rod is rotated, the driving member 12 rotates accordingly.

When the driving member 12 rotates, the helical gear 16 rotates via a transmission of the first gear 122, the second gear 142 and the worm 144.

A first carrier slide 20 is fixedly attached on a rear side of the housing 11. Two mounting plates 28 are respectively fixedly attached on two lateral sides of the first slide 20. Two rollers 29 are respectively rotatably mounted on the two lateral sides of the first slide 20 and located above the mounting plates 28. The mounting plates 28 and the rollers 29 are used to facilitate the first carrier slide 20 together with the master slide 10 to be slideably mounted on a headrail 30 (better seen in FIG. 5).

Figure 4:
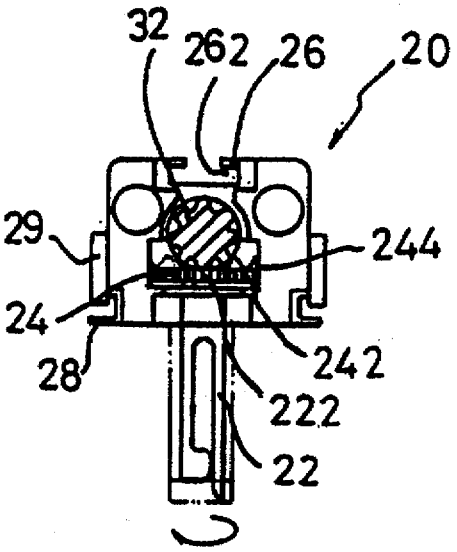
FIG. 4 is a front view showing the details of the first carrier slide of FIG. 1.

Now please refer to FIG. 4, which shows a detailed structure of the first carrier slide 20. The first carrier slide 20 includes a rack 24 laterally movably mounted in the first carrier slide 20. The rack 24 defines a side toothed portion 242 and a top toothed portion 244. A third gear 222 is vertically and rotatably mounted in the first carrier slide 20. The third gear 222 engages with the side toothed portion 242 of the rack 24. A clip 22 has a top end fixedly attached with the third gear 222 and extends downward through the first carrier slide 20. The clip 22 is used to clip a slat (not shown) of the vertical blind. A shaft 32 has an outer configuration matching the toothed configuration of the hollow portion 162. The shaft 32 is rotatably mounted through the first carrier slide 20 and has a front end engaging with the toothed configuration of the helical gear 16. The shaft 32 also engages with the top toothed portion 244. Thus, when the helical gear 16 is rotated, the clip 22 together with the slat clipped thereon rotates accordingly via a transmission of the shaft 32, the rack 24 and the third gear 222.

Figure 5:
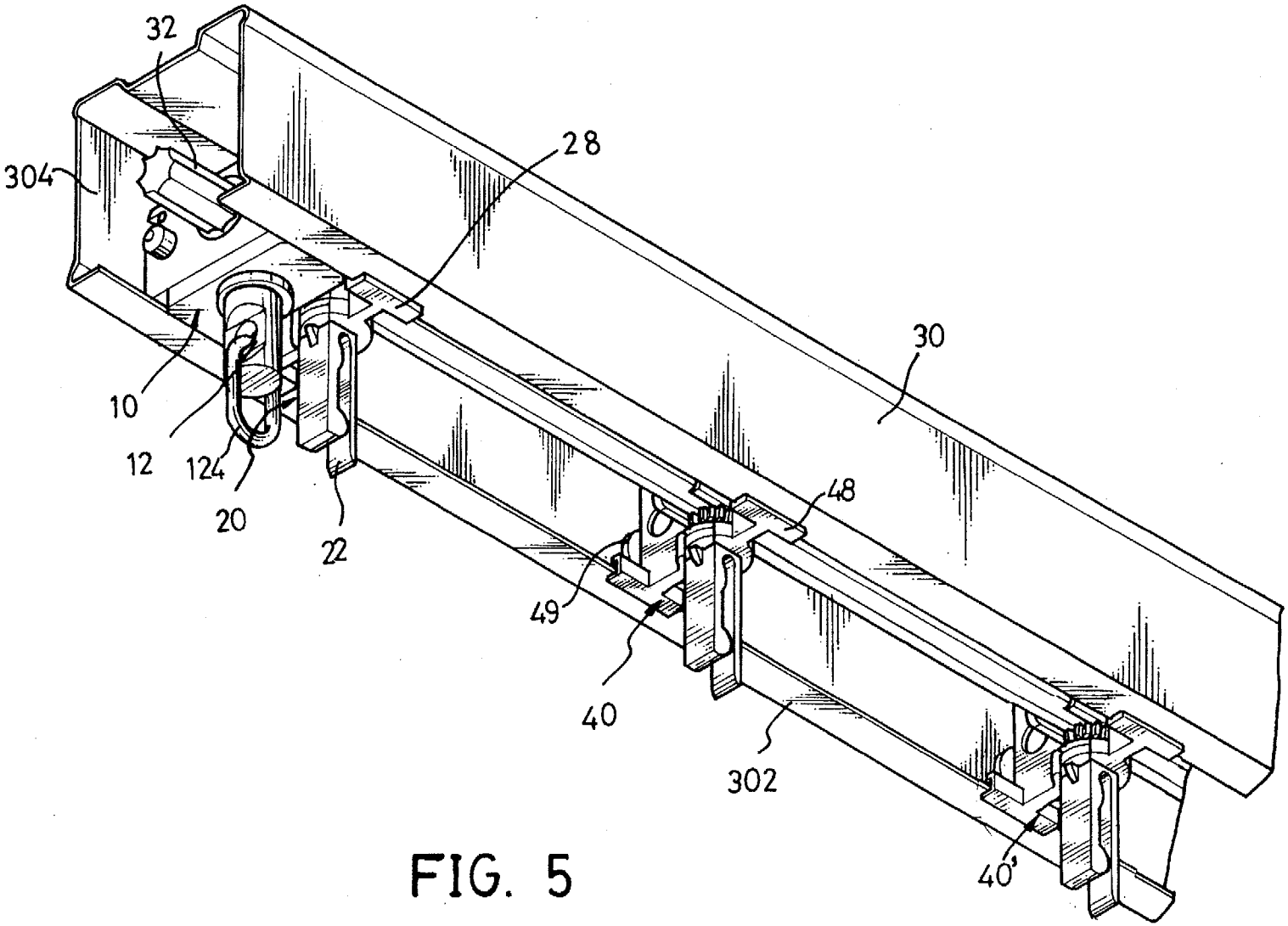
FIG. 5 is a bottom-rear-left perspective view showing that the master slide and the first carrier slide of FIG. 1 and a second and a third carrier slide are mounted on a headrail.

FIG. 5 shows that the master slide 10 which is fixedly attached with the first carrier 20 and a second carrier slide 40 and a third carrier slide 40' are mounted on the headrail 30. The second carrier slide 40 and the third carrier slide 40' respectively have a structure similar to that of the first carrier slide 20 so that descriptions about the structure of the second and third carrier slides 40, 40' are omitted here. The master slide 10 and the carrier slides 20, 40, 40' are mounted on the headrail 30 by sequentially inserting them into the headrail 30 from a side opening 304 thereof wherein, for example, two rollers 49 of the second carrier slide 40 are rotatably engaged with a top side of a rail portion 302 of the headrail 30 and Two mounting plates 48 thereof are slideably engaged with a bottom side of the rail portion 302.

Certainly, it can be understood by those skilled in the art that there generally are more than three carrier slides to constitute a vertical blind; however, for the reason of simplicity, only three carrier slides are shown to demonstrate how the present invention works.

FIGS. 6 to 9 show how the first, second and third carrier slides 20, 40, 40' are connected with each other and how they are operated to retract and extend the vertical blind constituted by the present invention.

A first strip 34 has a left end fixedly attached with the second carrier slide 40 and a right portion extending through a first strip accommodating space 262 defined by two opposing first protrusions 26 on a top of the first carrier slide 20 and a first strip accommodating slit 184 defined by two opposing L-shaped tabs 182 on a top of the cover 18 of the master slide 10 (better seen in FIGS. 2 and 4). The master slide 10 and the first carrier slide 20 can slideably move along the first strip 34. On the right end, the first strip 34 is formed to have two stops 342 which can engage with the opposing L-shaped tabs 182 on the top of the master slide 10 to limit the right-most end of travel of the master slide 10 with the first carrier slide 20 along the first strip 34.

A second strip 36 has a left end fixedly attached with the third carrier slide 40' and a right portion extending through a second strip accommodating space (not labeled) defined by two opposing second protrusions 46 on a top of the second carrier slide 40. The second strip 36 is formed to have two stops 362 on a right end thereof which can engage with the opposing second protrusions 46 on the top of the second carrier slide 40 to limit the right-most end of travel of the second carrier slide 40 along the second strip 36.

A third strip 38 has a left end fixedly attached with a further carrier slide (not shown) and a right portion extending through a third strip accommodating space (not labeled) defined by two opposing third protrusions 46' on a top of the third carrier slide 40'. The third strip 38 is formed to have two stops 382 on a right end thereof which can engage with the opposing third protrusions 46' on the top of the third carrier slide 40' to limit the right-most end of travel of the third carrier slide 40' along the third strip 38.

Here please note that as viewed from FIG. 5, the first strip 34 is on a level higher than that of the second and third strips 36 and 38 and the second strip 36 is on a level higher than that of the third strip 38.

Figure 6:
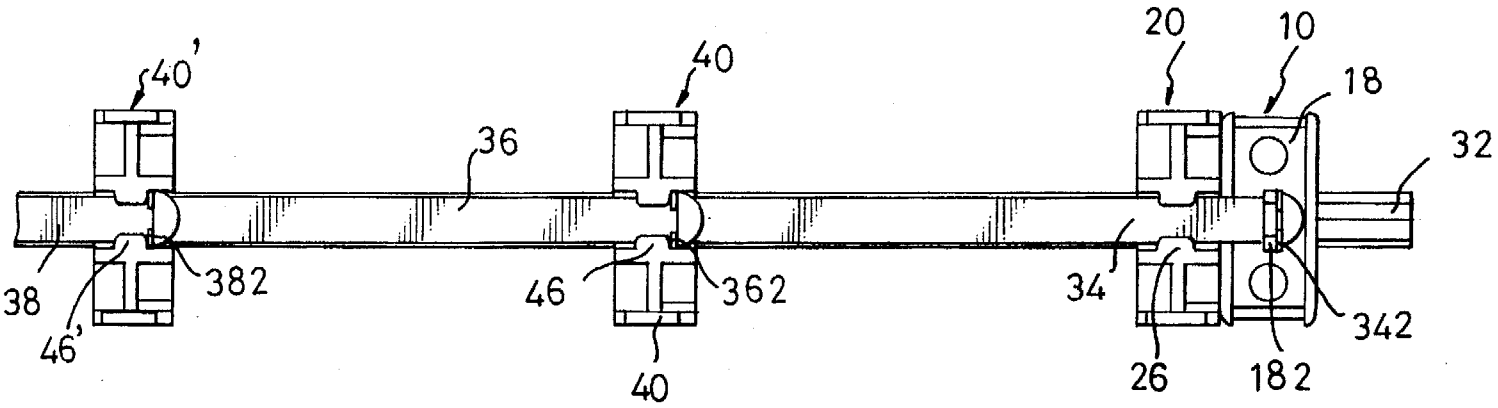
FIG. 6 is generally a top view of FIG. 5 with the headrail being removed.

To retract the vertical blind constituted by the present invention, all one has to do is to move the control rod (not shown) in connection with the master slide 10 via the link 124 and the driving member 12 (FIG. 1) toward the left of FIG. 6 to move the master slide 10 together with the first carrier slide 20 along the first strip 34 toward the left.

Figure 7:
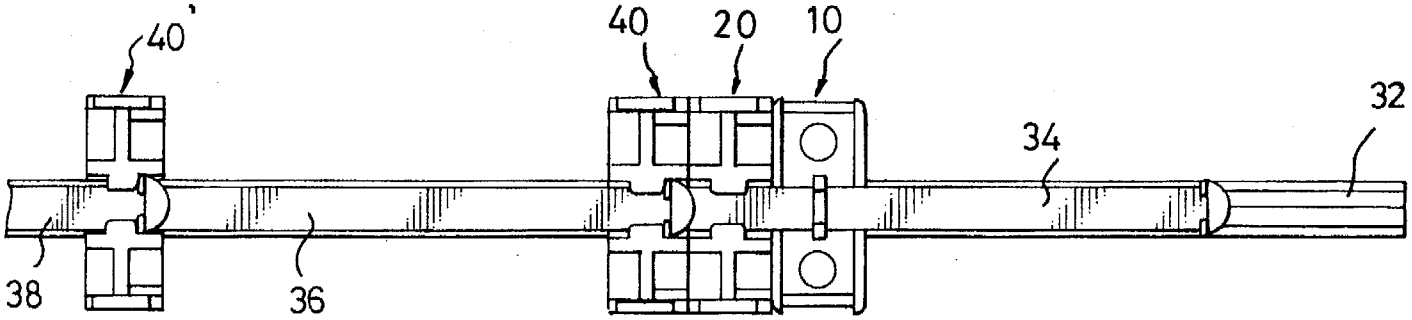
FIG. 7 is a view similar to FIG. 6 but showing that the master carrier together with the first carrier slide is moved to the left.

When the master carrier 10 and the first carrier slide 20 move to the left along the first strip 34, the first carrier slide 20 will firstly contact with the second carrier slide 40 as shown by FIG. 7. Then, as the first carrier slide 20 and the master carrier 10 continue to move toward the left, the first carrier slide 20 will push the second carrier slide 40 to move toward the left. Here, since the second carrier slide 40 is fixedly connected with the first strip 34, when the second carrier slide 40 is forced to move toward the left, it will cause the first strip 34 to also move toward the left so that the master slide 10, the first carrier slide 20, the second carrier slide 40 and the first strip 34 can simultaneously move toward the left along the second strip 36 when the first carrier slide 20 pushes the second carrier slide 40 to move toward the left.

When the master slide 10, the first carrier slide 20, the second carrier slide 40 and the first strip 34 continue to move toward the left along the second strip 36, firstly the second carrier slide 40 will contact with the third carrier slide 40' to push the third carrier slide 40' to move toward the left. Here since the third carrier slide 40' is fixedly connected with the left end of the second strip 36, when the third carrier slide 40 is forced to move toward the left, it will cause the second strip 36 to also move toward the left so that the master slide 10, the first carrier slide 20, the second carrier slide 40, the first strip 34, the third carrier slide 40' and the second strip 36 can simultaneously move toward the left along the third strip 38 to retract the vertical blind toward the left end as shown by FIG. 8.

Figure 8:
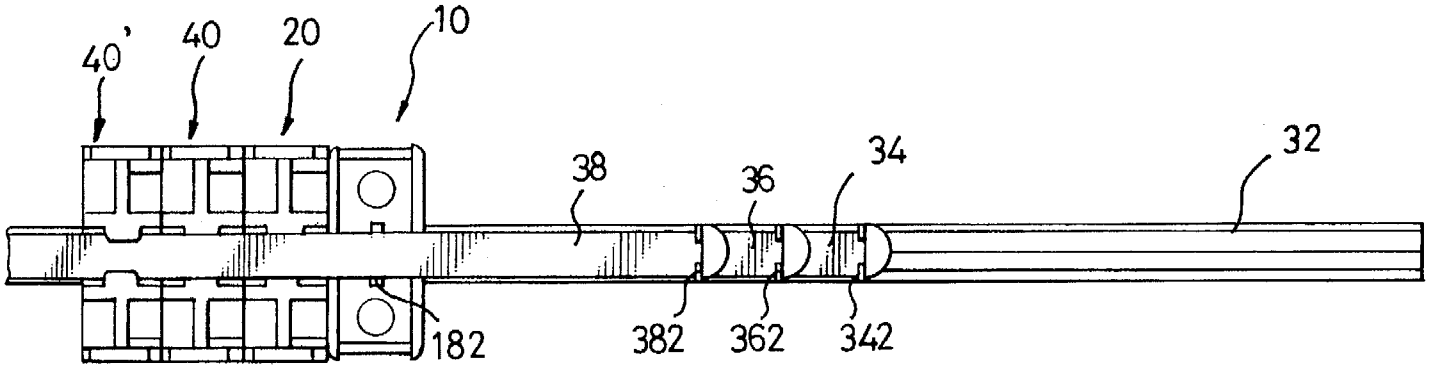
FIG. 8 is a view similar to FIG. 7 but showing that the master carrier together with the first, second and third carrier slides is moved to the left to retract the blind to the left of the drawings.

When the user wants to extend the vertical blind from the position as shown by FIG. 8, all the user has to do is to move the control rod (not shown) in connection with the master slide 10 toward the right of FIG. 8 to move the master slide 10 together with the first carrier slide 20 toward the right along the first strip When the master slide 10 together with the first carrier slide 20 continues to move toward the right, firstly the opposing L-shaped tabs 182 on the top of the master slide 10 will contact with the first stops 342 of the first strip 34 to push the first strip 34 to also move toward the right. Once the first strip 34 is forced to move toward the right, it will cause the second carrier slide 40 to also move toward the right along the second strip 36, since the left end of the first strip 34 is fixedly connected with the second carrier slide 40.

Figure 9:
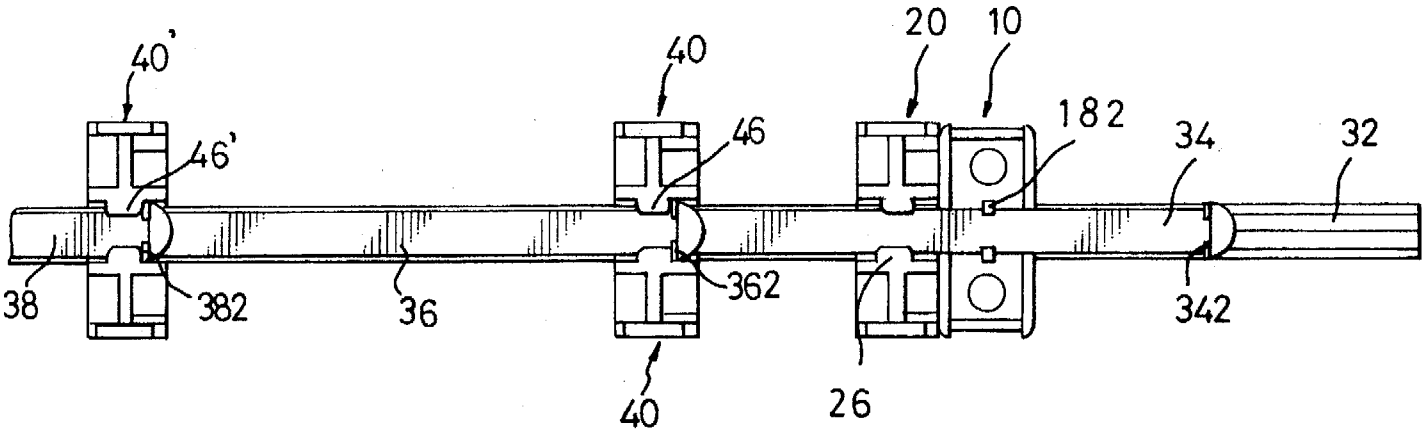
FIG. 9 is a view similar to FIG. 8 but showing that the master carrier together with the first, second and third carrier slides is moved from the left to the right to extend the blind.

When the master slide 10 together with the first carrier slide 20, the first strip 34 and the second carrier slide 40 continues to move toward the right, firstly the opposing second protrusions 46 on the top of the second carrier slide 40 will contact with the second stops 362 of the second strip 36 to push the second strip 36 to also move toward the right. Once the second strip 36 is forced to move to the right, it will cause the third carrier slide 40' to also move toward the right along the third strip 38, since the left end of the second strip 36 is fixedly connected with the third carrier slide 40' to reach a position as shown in FIG. 9, in which the third protrusions 46' on the top of the third carrier slide 40' are engaged with the third stops 382 on the right end of the third strip 38.

From the above descriptions, it is understood that the present invention can achieve the two functions, i.e., adjusting the orientation of the slats and extending or retracting the vertical blind, by only manipulating a single control rod in connection with the master slide 10. The present invention does not need an additional cord to achieve the extension or retraction of the vertical blind.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An apparatus for adjusting the orientation of slats of a vertical blind, comprising:

a master slide and a plurality of carrier slides adapted to be slideably mounted on a headrail of the vertical blind, said master slide comprising:

a housing;

a driving member adapted to be connected with a control rod, rotatably mounted on the housing and defining a first gear, a worm member rotatably mounted in the housing and defining a second gear engaging with the first gear and a worm; and a helical gear rotatably mounted in the housing and engaging with the worm;

a force transmission member engaging with the helical gear and extending from the master carrier to each of the carrier slides to transmit a rotating force from the driving member to the carrier slides;

said carrier slides respectively comprising driven means each having an attaching member adapted to attach with a slat, the driven means being used to receive the rotating force from the force transmission member to cause a pivoting movement of the attaching members, the carrier slides having a first carrier slide fixedly attached with the master slide; and a plurality of strips respectively slideably engaging with the carrier slides, each strip having a first end defining a stop for blocking the movement of a respective carrier slide along the strip and a second end fixedly attached with a carrier slide neighboring the respective carrier slide slideably engaging with the strip.

2. The apparatus in accordance with claim 1, wherein the helical gear has a hollow portion with a toothed configuration.

3. The apparatus in accordance with claim 2, wherein the force transmission member is a shaft having an outer configuration mating the toothed configuration of the hollow portion.

4. The apparatus in accordance with claim 3, wherein each of the driven means comprises a rack linearly movably mounted in a respective carrier slide and defining a first toothed portion engaging with the shaft and a second toothed portion, a driven member rotatably mounted in the respective carrier slide and defining a third gear engaging with the second toothed portion and the attaching member adapted to attach with a slat.

5. The apparatus in accordance with claim 1, wherein the attaching member is a clip.

6. The apparatus in accordance with claim 1, wherein the strip slideably engaging with the first carrier slide is also slideably engaged with the master slide.

* * * * *